United States Patent [19]

Cole

[11] Patent Number: 4,577,417

[45] Date of Patent: Mar. 25, 1986

[54] SOLE-AND-HEEL STRUCTURE HAVING PREMOLDED BULGES

[75] Inventor: George S. Cole, Pebble Beach, Calif.

[73] Assignee: Energaire Corporation, Pebble Beach, Calif.

[21] Appl. No.: 604,895

[22] Filed: Apr. 27, 1984

[51] Int. Cl.[4] ..... A43B 13/20

[52] U.S. Cl. ..... 36/29; 36/28; 36/30 R

[58] Field of Search ..... 36/29, 28, 30 R, 32, 36/35 B, 3 B

[56] References Cited

U.S. PATENT DOCUMENTS

| | | | |
|---|---|---|---|
| 508,034 | 11/1893 | Moore . | |
| 547,645 | 10/1895 | Lacroix . | |
| 586,155 | 7/1897 | Bascom . | |
| 745,793 | 12/1903 | Corman . | |
| 850,327 | 4/1907 | Tauber . | |
| 1,278,320 | 9/1918 | Ellithorpe . | |
| 1,605,985 | 11/1926 | Rasmussen . | |
| 1,977,695 | 10/1934 | Pinaud . | |
| 2,532,742 | 12/1950 | Stoiner . | |
| 2,549,343 | 4/1951 | Stoiner . | |
| 2,605,560 | 8/1952 | Gouabault . | |
| 2,677,904 | 5/1954 | Reed . | |
| 2,863,230 | 12/1958 | Cortina . | |
| 3,044,190 | 7/1962 | Urbany . | |
| 3,225,463 | 12/1965 | Burnham . | |
| 3,417,494 | 12/1968 | Claff | 36/3 B |
| 3,871,117 | 3/1975 | Richmond et al. . | |
| 4,071,963 | 2/1978 | Fukuoka . | |
| 4,224,749 | 9/1980 | Diaz-Cano . | |
| 4,237,625 | 12/1980 | Cole et al. . | |
| 4,358,902 | 11/1982 | Cole et al. . | |
| 4,458,430 | 7/1984 | Peterson | 36/35 B |

FOREIGN PATENT DOCUMENTS

| | | | |
|---|---|---|---|
| 73695 | 4/1916 | Fed. Rep. of Germany . | |
| 1287477 | 5/1953 | Fed. Rep. of Germany . | |
| 871261 | 7/1961 | Fed. Rep. of Germany . | |
| 336981 | 11/1903 | France . | |
| 809045 | 7/1951 | German Democratic Rep. | 36/35 |
| 70141 | 9/1915 | Switzerland . | |
| 16240 | of 1894 | United Kingdom . | |
| 440398 | 10/1934 | United Kingdom . | |

OTHER PUBLICATIONS

Literature on Energaire Shoes, Ad in *Chicago Tribune*, Jan. 20, 1980.

*Primary Examiner*—Werner H. Schroeder
*Assistant Examiner*—Mary A. Ellis
*Attorney, Agent, or Firm*—Emrich & Dithmar

[57] ABSTRACT

In one embodiment, the sole-and-heel structure includes an outer member having a sole portion and a heel portion. A bulge is molded into the heel portion and a bulge is molded into the sole portion in the metatarsal region thereof. A thin sealing member is attached to the outer member with adhesive to hermetically seal the cavities defined by the two bulges. A passageway between the two cavities enables air to move back and forth during movement of a person wearing shoes incorporating such sole-and-heel structure.

20 Claims, 9 Drawing Figures

SOLE-AND-HEEL STRUCTURE HAVING PREMOLDED BULGES

BACKGROUND OF THE INVENTION

U.S. Pat. Nos. 4,237,625 and 4,358,902 in which one of the patentees is the applicant herein, disclose sole-and-heel structures with one or more cavities in the sole portion and one or more cavities in the heel portion. The cavity or cavities in the sole portion are located immediately behind the foot's metatarsal region. The cavities are covered by a thin material. Pressurized fluid is delivered to these cavities through a suitable valve. The pressurized fluid has a ballooning effect on the thin cavity covers causing them to bulge below the main plane of the sole-and-heel structure. These bulges come into contact with the pavement. At rest, the foot is cushioned comfortably on the pressurized fluid in the bulges. In moving, fluid under pressure, alternates through a passageway between the heel and metatarsal cavities, producing an alternate lifting effect. The bulges facilitate movement by providing forward thrust to the heel and to the metatarsal region.

The sole-and-heel structure must have high wear resistant capabilities so as not to deteriorate rapidly as it contacts the pavement. The bulges in the structures described in these prior art patents are thin in order to balloon out as the result of pressurization. The thinness causes such sole-and-heel structures to have a tendency to wear out more quickly in the areas of the bulges.

Furthermore, the valve itself makes these prior art structures expensive to make. Also, the pressurized fluid tends to escape so that fluid would have to be added from time to time. Finally, the pressurized fluid causes the walls of the cavities in these sole-and-heel structures to be under constant stress, even during nonuse of the shoes incorporating such structure.

SUMMARY OF THE INVENTION

It is therefore an important object of the present invention to provide improved sole-and-heel structures which, although having the advantages of shock absorption and the movement facilitation in the prior patents discussed above, are more wear resistant.

Another object is to provide sole-and-heel structures which do not require the addition of pressurized fluid.

Another object is to make sole-and-heel structures less expensively.

Another object is to reduce stress in the cavities when the shoe is not in use.

In summary, there is provided a shoe including a sealing member having a shape that substantially matches the shape of the shoe and being impermeable to air and having a sealing surface, sole-and-heel structure comprising an elongated, molded, one-piece outer member including a sole portion and a heel portion, the outer member having interior and exterior surfaces, the outer member having a construction to be highly wear resistant to enable the exterior surface to contact the pavement or the like during use, a heel bulge molded into the heel portion and projecting from the exterior surface, a metatarsal bulge molded into the sole portion in the metatarsal region thereof and projecting from the exterior surface, the heel and metatarsal bulges respectively defining heel and metatarsal cavities opening at the interior surface, a restricted passageway molded into the outer member between the heel and metatarsal cavities and opening to the interior surface, and adhesive means between the sealing surface and the interior surface for hermetically attaching the sealing member to the outer member, whereby air at atmospheric pressure is permanently located in the space jointly defined by the passageway and the cavities, whereby at rest a foot on the sole-and-heel structure is cushioned comfortably on the air in the cavities, and in moving such air alternates through the passageway between the heel and metatarsal cavities so as to provide shock absorption and an alternate lifting effect by the bulges which provide forward thrust both in the heel portion and the sole portion that facilitates moving.

In another aspect of the invention, there is provided sole-and-heel structure for attachment to a shoe or the like, comprising an elongated, molded, one-piece resilient outer member including a sole portion and a heel portion, the outer member having interior and exterior surfaces, the outer member having a construction to be highly wear resistant to enable the exterior surface to contact the pavement or the like during use, a heel bulge molded into the heel portion and projecting from the exterior surface, a metatarsal bulge molded into the sole portion in the metatarsal region thereof and projecting from the exterior surface, the heel and metatarsal bulges respectively defining heel and metatarsal cavities opening at the interior surface, a restricted passageway molded into the outer member between the heel and metatarsal cavities and opening to the interior surface, a plate-like sealing member having a shape that matches the shape of the outer member, the sealing member being substantially impermeable to air and having a sealing surface, and adhesive means between the sealing surface and the interior surface for hermetically attaching the sealing member to the outer member, whereby air at atmospheric pressure is permanently located in the space jointly defined by the passageway and the cavities, whereby at rest a foot on the sole-and-heel structure is cushioned comfortably on the air in the cavities, and in moving, such air alternates through the passageway between the heel and metatarsal cavities so as to provide shock absorption and an alternate lifting effect by the bulges which provide forward thrust both in the heel portion and the sole portion that facilitates moving.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
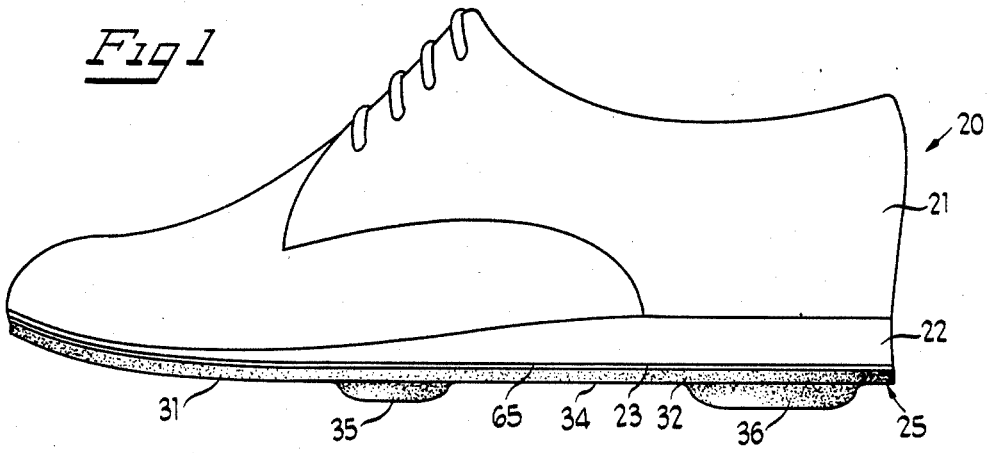
FIG. 1 is a side elevation of a shoe embodying sole-and-heel structure incorporating the features of the present invention.
Figure 2:
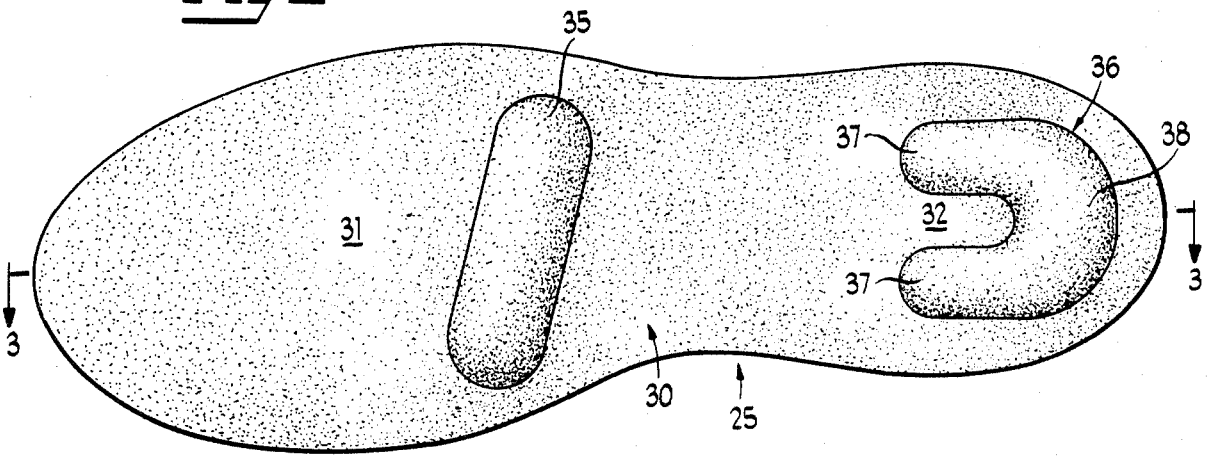
FIG. 2 is a bottom plan view of the shoe of FIG. 1 on an enlarged scale.
Figure 3:
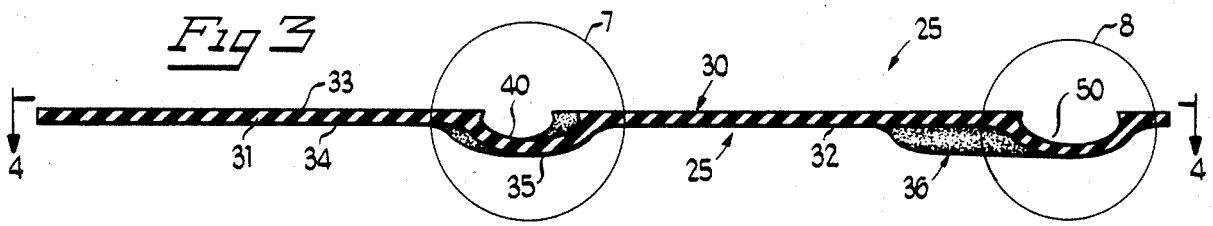
FIG. 3 is a view in longitudinal section of the sole-and-heel structure alone, taken along the line 3—3 of FIG. 2.
Figure 4:
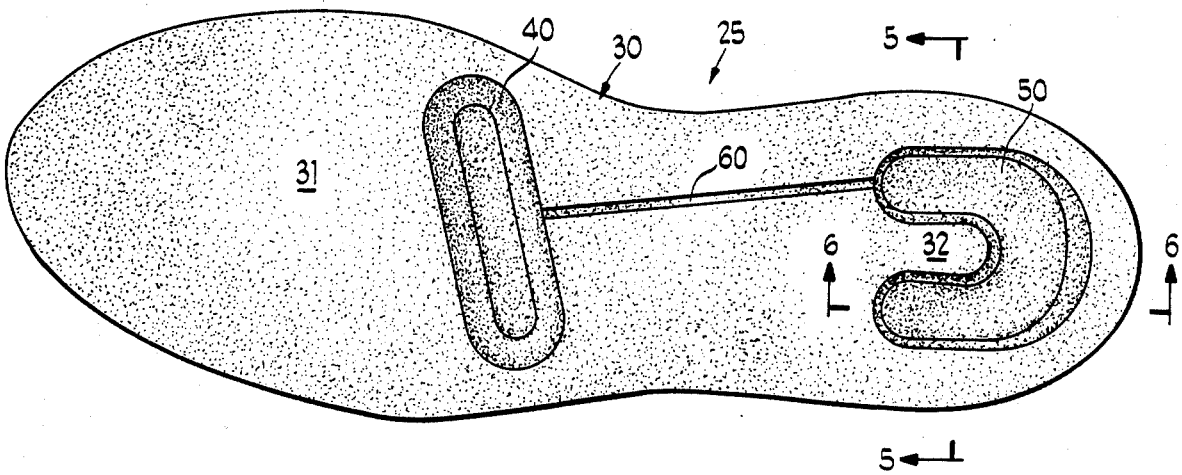
FIG. 4 is a top plan view taken along the line 4—4 of FIG. 3.
Figure 5:
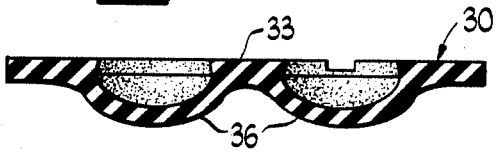
FIG. 5 is an enlarged sectional view taken along the line 5—5 of FIG. 4.
Figure 6:
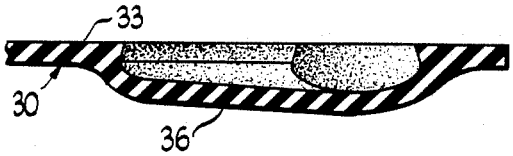
FIG. 6 is an enlarged sectional view taken along the line 6—6 of FIG. 4.

Turning now to the drawings, and more particularly to FIG. 1 thereof there is depicted a shoe 20 having a conventional upper portion or last 21 and a so-called mid sole 22 which is generally of wedge shape, whereby the shoe 20 is referred to as being of the "wedge" type. The sole 22 has a downwardly facing surface 23.

Referring also to FIGS. 2–8, sole-and-heel structure 25 is affixed to the shoe 20. The structure 25 comprises a generally flat, thin, elongated outer member 30, the member 30 being of one-piece, molded construction, preferably rubber. In an operative embodiment, the member had a thickness of 0.125 inch. It is essential that the outer member 30 be highly wear resistant since it is subject to constant engagement with the pavement. A preferred composition is made by The Goodyear Tire and Rubber Company under its brand name INDY 500.

The outer member 30 has a sole portion 31 located under the sole of one's foot and a heel portion 32 located under the person's heel. The outer member 30 has a substantially planar interior surface 33 and a substantially planar exterior surface 34, which surfaces are generally parallel. It is the exterior surface 34 which contacts the pavement. A metatarsal bulge 35 is molded into the sole portion 31 in the metatarsal region thereof and projects downwardly from the exterior surface 34. Likewise, a heel bulge 36 is molded into the heel portion 32 and projects downwardly from the exterior surface 34. The bulge 36 is U-shaped in plan, having a pair of legs 37 extending substantially parallel to the longitudinal axis of the member 30, and a curved bight 38 disposed away from the sole portion 31, at the rear of the outer member 30. The legs 37 increase the lateral stability of a person wearing the shoe 20.

The metatarsal bulge 35 defines a cavity 40 opening to the interior surface 33. The cavity 40 is elongated having parallel side walls and part-cylindrical end walls. The cavity 40 is canted to the longitudinal axis of the outer member 30 so that it is generally parallel to the metatarsal area of a person's foot. As an example, the cavity 40 may be located such that its transverse axis is about ⅛ inch rearwardly of the transverse center line of the metatarsal ball area of the foot for which the member 30 is sized.

Figure 7:
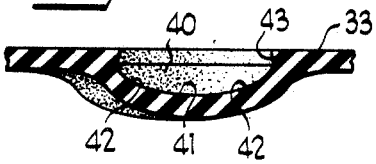
FIG. 7 is an enlarged view of the portion of FIG. 3 within the circle labeled "7"

FIG. 7 depicts a preferred form of the cavity 40, which has a bottom wall 41 and two side walls 42, all being part-cylindrical, the radius of curvature of the bottom wall 41 being preferably greater than the radius of curvature of the side walls 42. In the embodiment shown, the cavity 40 is undercut at 43 around its entirety for purposes to be described.

Figure 8:
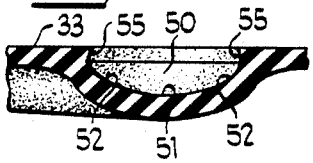
FIG. 8 is an enlarged view of the portion of FIG. 3 within the circle labeled "8"

The heel bulge 36 defines a heel cavity 50 opening to the interior surface 33. FIG. 8 depicts a preferred form of the cavity 50, which has a bottom wall 51 and two side walls 52, all being part-cylindrical, the radius of curvature of the bottom wall 51 being preferably greater than the radius of curvature of the side walls 52. The cavity 50 is undercut at 55 around its entirety for purposes to be described.

In a preferred embodiment the volumes of the cavities 40 and 50 are substantially the same.

Finally, a restricted passageway 60 (FIG. 4) is molded into the outer member 30, between the cavities 40 and 50 and opening to the interior surface 33.

Referring to FIG. 1, between the interior surface 33 of the outer member 30 and the surface 23 of the mid sole 22 is an adhesive 65. The outer member 30 and the mid sole 22 are thus attached and the cavities 40 and 50 hermetically sealed, whereby air at atmospheric pressure is permanently located in the space jointly defined by the cavities 40 and 50 and the passageway 60.

In use, the bulges 35 and 36 engage the pavement as the wearer of the shoe 20 is standing. The air in the cavities 40 and 50 provides a cushioning effect. In walking and running, the heel bulge 36 first comes in contact with the pavement, causing air in the cavity 50 to be compressed and forced through the passageway 60 into the cavity 40. As the heel portion 32 lifts off the pavement, the air returns to the cavity 50 to give a lifting effect. As the bulge 35 contacts the pavement, the air in the cavity 40 is forced through the passageway 60 into the cavity 50. In walking and running, the air alternates back and forth between the cavities 40 and 50, through the passageway 60 to give an alternate lifting effect and provide thrust both at the metatarsal ball area and in the heel that facilitates walking and running. The weight of the wearer produces energy in placing the cavities 40 and 50 under pressure and transferring air from the heel to the metatarsal region and vice versa.

Although the exterior surface 34 is shown to be smooth, that is not necessary. A tread, such as is used in athletic shoes could be added to such exterior surface. Also, although a wedge type shoe 20 is depicted, a structure in which the forward part of the heel structure is substantially vertical can be formed, as long as the sole and heel portions are unitary.

The particular shapes of the cavities 40 and 50 depicted in the drawings are not necessary, although they are preferred, having the advantages discussed above. However, other shaped cavities would perform well also.

It is important that the mid sole 22 function as a sealing member, that is, it must be impermeable to air. The cavities 40 and 50 must be hermetically sealed. The adhesive 65, the mid sole 22 and the outer member 30 all must be substantially impermeable to air. Of course, the member 30 and the mid sole 22 must be resilient in order to flex during use of the shoe 20. Rubber is preferred in this regard.

Those skilled in the art of manufacturing rubber products such as the member 30 will readily know how to make the same. Suffice it to say that the tooling and the molding machine will permanently form the bulges 35 and 36 and the corresponding cavities 40 and 50 during the molding operation.

The undercuts 43 and 55 (FIGS. 7 and 8) improve adhesion of the outer member 30 to the mid sole 22 in the region of the cavities 40 and 50. Stress produced by the air in these cavities at the junction react as shear stresses rather than peel stresses. Of course, the use of atmospheric pressure instead of the higher pressures disclosed in the prior art substantially reduces the stresses in the structure 25.

When the shoe is not worn or at least the wearer is not standing or running, there is no pressure in the cavities, and therefore, no stress that could break the seal over time. Pressure is only developed, as explained above, when the wearer is standing, walking or running.

The thickness of the outer member 30 is sufficient so that it is inherently capable of withstanding the stress to which any sole-and-heel structure is put during walking, running, etc. No metatarsal stiffener is required, as disclosed in the previous patents, to stiffen the sole while enabling it to balloon in the areas desired. Of course, without such a stiffener, the sole itself is more flexible.

Each size shoe preferably would have different size bulges and cavities. A larger shoe would have a longer metatarsal bulge 35 and a larger heel bulge 36.

Figure 9:
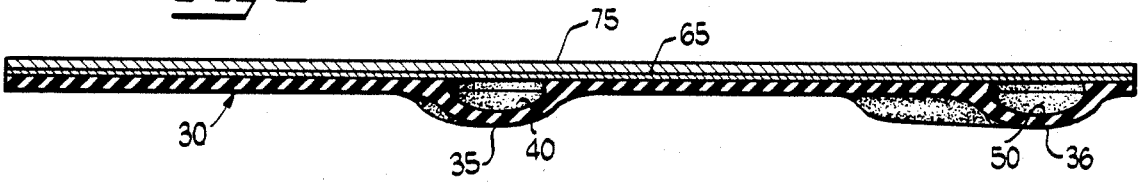
FIG. 9 is a view in longitudinal section like FIG. 3, but depicting a second embodiment of the invention.

Referring to FIG. 9 an alternative embodiment is depicted which is intended for the replacement market. In the embodiment of FIG. 9, the identical outer member 30 is utilized. A plate-like sealing membrane or member 75 has a shape that matches the shape of the outer member 30 and in the embodiment shown is somewhat thinner. Adhesive 65 between the sealing member 75 and the outer member 30 permanently attach the two to provide hermetically sealed cavities 40 and 50 in the same manner as described with respect to the first embodiment. A cobbler would have a supply of the sole-and-heel structures to repair shoes in the usual way. The exposed surface of such structure would be attached in any number of ways to the existing mid sole of a shoe brought in for repair. The cobbler need not be concerned with insuring a hermetic seal because that is already provided in the product itself.

What has been described therefore, is improved sole-and-heel structure with molded-in bulges defining cavities that are hermetically sealed.

I claim:

1. Sole-and-heel structure comprising an elongated, molded, one-piece resilient outer memeber including a sole portion and a heel portion, said outer member having interior and exterior surfaces, said outer member having a construction to be highly wear resistant to enable said exterior surface to contact a support surface during use, a heel bulge molded into said heel portion and projecting from said exterior surface, said heel bulge being located under the area occupied by the heel area of one's foot, a metatarsal bulge molded into said sole portion and projecting from said exterior surface, said metatarsal bulge being located under the area normally occupied by the metatarsal area of one's foot, said sole portion having no bulges in the area normally occupied by one's toes, said heel and metatarsal bulges respectively defining heel and metatarsal cavities opening at said interior surface, said heel bulge and said metatarsal bulge respectively projecting from said exterior surface without the application of any elevated fluid pressure in said heel and metatarsal cavities, a restricted passageway molded into said outer member between said heel and metatarsal cavities and opening to said interior surface, a sealing member having a shape that matches the shape of said outer member, said sealing member being impermeable to air and having a sealing surface, and adhesive means between said sealing surface and said interior surface for hermetically attaching said sealing member to said outer member, whereby air at atmospheric pressure is permanently located in the space jointly defined by said passageway and said cavities, whereby at rest a foot on said sole-and-heel structure is cushioned comfortably on the air in said cavities, and in moving such air alternates through said passageway between said heel and metatarsal cavities so as to provide shock absorption and an alternate lifting effect by said bulges which provide forward thrust both in said heel portion and said sole portion that facilitates moving.

2. The sole-and-heel structure of claim 1, wherein said outer member has no more than one heel bulge and associated heel cavity and no more than one metatarsal bulge and associated metatarsal cavity.

3. The sole-and-heel structure of claim 1, wherein said heel bulge and said heel cavity are U-shaped having two side legs for lateral stability and a bight away from said sole portion.

4. The sole-and-heel structure of claim 1, wherein each of said cavities is undercut in the region of said interior surface.

5. The sole-and-heel structure of claim 1, wherein said metatarsal bulge and said metatarsal cavity are elongated and located slightly behind the metatarsal area of a foot to be housed in the shoe.

6. The sole-and-heel structure of claim 1, wherein said sealing and outer members are composed of rubber.

7. The sole-and-heel structure of claim 1, wherein the volume of each of said cavities is substantially the same.

8. The sole-and-heel structure of claim 1, wherein the thickness of said outer member is on the order of about 0.125 inch.

9. The sole-and-heel structure of claim 1, wherein the thickness of said bulge is substantially the same as the thickness of said outer member.

10. The sole-and-heel structure of claim 1, wherein said sealing member is platelike.

11. In a shoe including a sealing member having a shape that substantially matches the shape of the shoe and being impermeable to air and having a sealing surface, sole-and-heel structure comprising an elongated, molded, one-piece outer member including a sole portion and a heel portion, said outer member having interior and exterior surfaces, said outer member having a construction to be highly wear resistant to enable said exterior surface to contact a support surface during use, a heel bulge molded into said heel portion and projecting from said exterior surface, said heel bulge being located under the area occupied by the heel area of one's foot, a metatarsal bulge molded into said sole portion in the metatarsal region thereof and projecting from said exterior surface, said metatarsal bulge being located under the area normally occupied by the metatarsal area of one's foot, said sole portion having no bulges in the area normally occupied by one's toes, said heel and metatarsal bulges respectively defining heel and metatarsal cavities opening at said interior surface, said heel bulge and said sole bulge respectively projecting from said exterior surface without the application of any elevated fluid pressure in said heel and metatarsal cavities, a restricted passageway molded into said outer member between said heel and metatarsal cavities and opening to said interior surface, and adhesive means between said sealing surface and said interior surface for hermetically attaching said sealing member to said outer member, whereby air at atmospheric pressure is permanently located in the space jointly defined by said passageway and said cavities, whereby at rest a foot on said sole-and-heel structure is cushioned comfortably on the air in said cavities, and in moving such air alternates through said passageway between said heel and metatarsal cavities so as to provide shock absorption and an alternate lifting effect by said bulges which provide forward thrust both in said heel portion and said sole portion that facilitates moving.

12. In the shoe of claim 11, wherein said outer member has no more than one heel bulge and associated heel cavity and no more than one metatarsal bulge and associated metatarsal cavity.

13. In the shoe of claim 11, wherein said heel bulge and said heel cavity are U-shaped having two side legs for lateral stability and a bight away from said sole portion.

14. In the shoe of claim 11, wherein each of said cavities is undercut in the region of said interior surface.

15. In the shoe of claim 11, wherein said metatarsal bulge and said metatarsal cavity are elongated and located slightly behind the metatarsal area of a foot to be housed in the shoe.

16. In the shoe of claim 11, wherein said sealing and outer members are composed of rubber.

17. In the shoe of claim 11, wherein the volume of each of said cavities is substantially the same.

18. In the shoe of claim 11, wherein the thickness of said outer member is on the order of about 0.125 inch.

19. In the shoe of claim 11, wherein the thickness of said bulge is substantially the same as the thickness of said outer member.

20. In the shoe of claim 19, wherein the thickness of the bulge is in the order of about 0.125 inch.

* * * * *

UNITED STATES PATENT AND TRADEMARK OFFICE

CERTIFICATE OF CORRECTION

PATENT NO. : 4,577,417

DATED : March 25, 1986

INVENTOR(S) : George S. Cole

It is certified that error appears in the above—identified patent and that said Letters Patent is hereby corrected as shown below:

[56] References Cited
The following references were omitted:
U.S. 897,920 Sept. 1908 McIntyre Foreign
2039717 8/1980 United Kingdom
1461743 11/1966 France
643881 6/1964 France Claim 1, column 5, line 43, "memeber" should be --member--.

Signed and Sealed this

*Twenty-second* Day of *July 1986*

[SEAL]

*Attest:*

DONALD J. QUIGG

*Attesting Officer* *Commissioner of Patents and Trademarks*